United States Patent [19]

Nystrom

[11] 4,129,138

[45] Dec. 12, 1978

[54] SYSTEMS FOR SUPPLYING TREATMENT LIQUIDS TO ROTATABLE ELECTROPLATING DRUMS

[76] Inventor: Bror E. Nyström, Rosenvägen 21, S-560 23 Bankeryd, Sweden

[21] Appl. No.: 855,070

[22] Filed: Nov. 25, 1977

[51] Int. Cl.[2] ..... B08B 3/02

[52] U.S. Cl. ..... 134/145; 134/146; 134/153

[58] Field of Search ..... 134/97–98, 134/140, 145–146, 149, 153, 155, 199

[56] References Cited

U.S. PATENT DOCUMENTS

| | | | |
|---|---|---|---|
| 2,395,009 | 2/1946 | Nundy | 134/145 X |
| 3,286,718 | 11/1966 | Kumpf | 134/140 |
| 3,428,059 | 2/1969 | Wenzel et al. | 134/140 |
| 3,916,937 | 11/1975 | Nystrom | 134/153 X |

*Primary Examiner*—Robert L. Bleutge
*Attorney, Agent, or Firm*—Holman & Stern

[57] ABSTRACT

A system for supplying treatment liquids to an electroplating drum rotatably mounted in trunnion bearings comprises at least two sets of ducts of different sizes opening into the electroplating drum and disposed in two series about a through bore of the bearing. An axially fluted inner surface of the through bore cooperates with a cylindrical outer surface of a removable cleaning tube to define one set of ducts. A liquid distribution valve allows treatment liquid to be supplied either to the two sets of ducts or to only one of the sets of ducts. Removal of the cleaning tube from the bearing allows overhaul of the one set of ducts.

4 Claims, 5 Drawing Figures

SYSTEMS FOR SUPPLYING TREATMENT LIQUIDS TO ROTATABLE ELECTROPLATING DRUMS

The invention relates to systems for supplying varying quantities of treatment liquids to electroplating drums.

Swedish Pat. Nos. 332,108 and 371,456 disclose systems and methods in which movement is imparted to the rinsing liquid instead of the material which is to be treated and is disposed in the container of the electroplating drum. In this way it is possible to utilize the advantages of counterflow rinsing although the entire counterflow rinsing procedure is performed in a single rinsing station.

It is a condition for the proper functioning of the above-stated rinsing method that means be provided through which the material in the electroplating drum is rinsed with substantial quantities of recirculating liquids and to some extent is flushed with relatively small quantities of clean water so that the rinsing and flushing ducts become readily accessible for the cleaning away of dirt, etc.

A simpler system for rinsing is disclosed in the Swedish Pat. No. 211,026. The rinsing hub construction disclosed therein cannot be used for modern complicated recirculating rinsing systems because the rinsing hub itself is able to admit rinsing liquid only at a constant rate. This means that recirculation rinsing would require an excessive amount of time if the rinsing liquids were to enter the drum through small spraying apertures. The relationship is reversed if the rinsing apertures are made larger to meet the demand of recirculating rinsing for greater quantities of liquid but in this case the consumption of fresh water would become inacceptably large. It is a further disadvantage that this arrangement does not facilitate cleaning of the rinsing ducts.

According to the invention there is provided a system for supplying varying quantities of treatment liquids to an electroplating drum arranged to rotate in rinsing trunnion bearings through which sets of ducts pass and which are disposed in a frame, the system comprising at least one rinsing trunnion bearing provided with at least two sets of ducts with openings of different size disposed in respective series about a central bore which extends through the rinsing trunnion bearing, a liquid distribution valve disposed in the frame and arranged to allow the sets of ducts to cooperate with each other or to perform separate rinsing functions, the ducts of one of the sets of ducts being formed by axially extending flutes in the central bore cooperating with a smooth cylindrical external surface of a removable cleaning tube inserted into the central bore so that removal of the cleaning tube from the rinsing trunnion bearing makes the one set of ducts accessible for overhaul operations.

The invention will be further described, by way of example, with reference to the accompanying drawings, in which.

Figure 1:
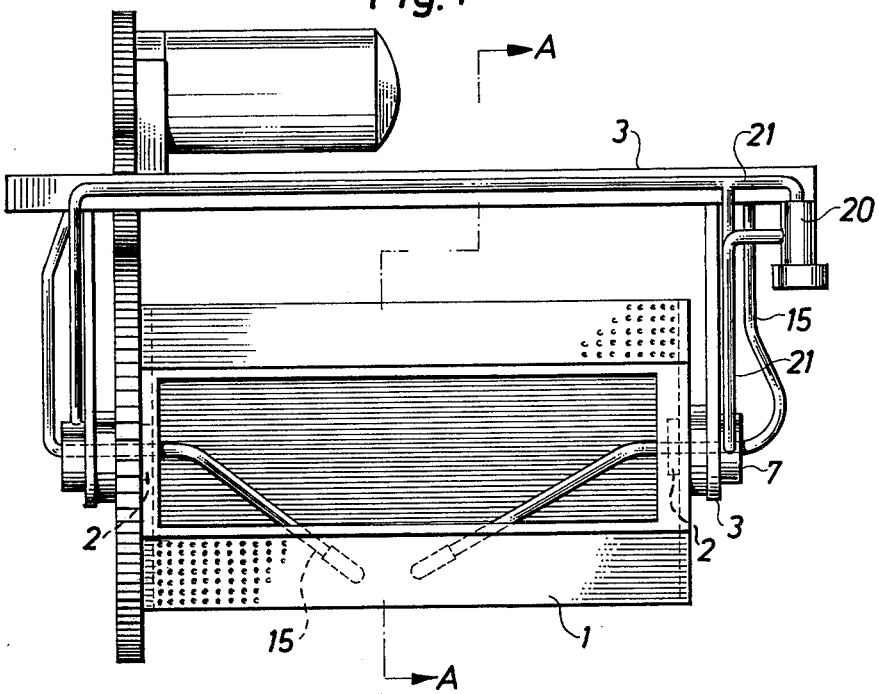
FIG. 1 is a front view of an electroplating drum which is rotatably driven by a geared motor and is disposed in a rinsing trunnion bearing.
Figure 2:
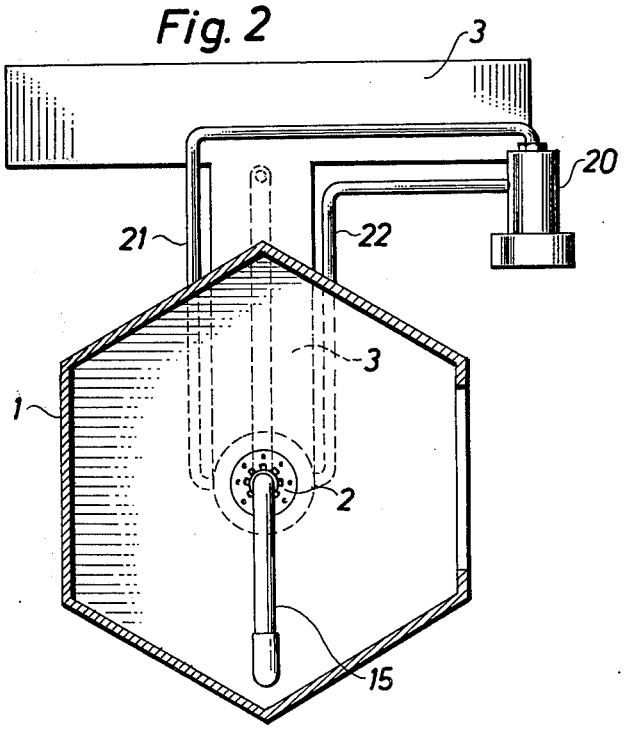
FIG. 2 shows to a larger scale a section through the electroplating drum along the line A—A of FIG. 1.

The electroplating drum 1 shown in FIGS. 1 and 2 is arranged to rotate by means of two rinsing trunnion bearings 2 which are mounted in a frame 3. The frame, together with an electroplating drum and a liquid distribution valve 20 mounted on the frame, can be lowered into a treatment tank, not shown, also referred to as a rinsing station, in which the various rinsing operations take place.

Figure 3:
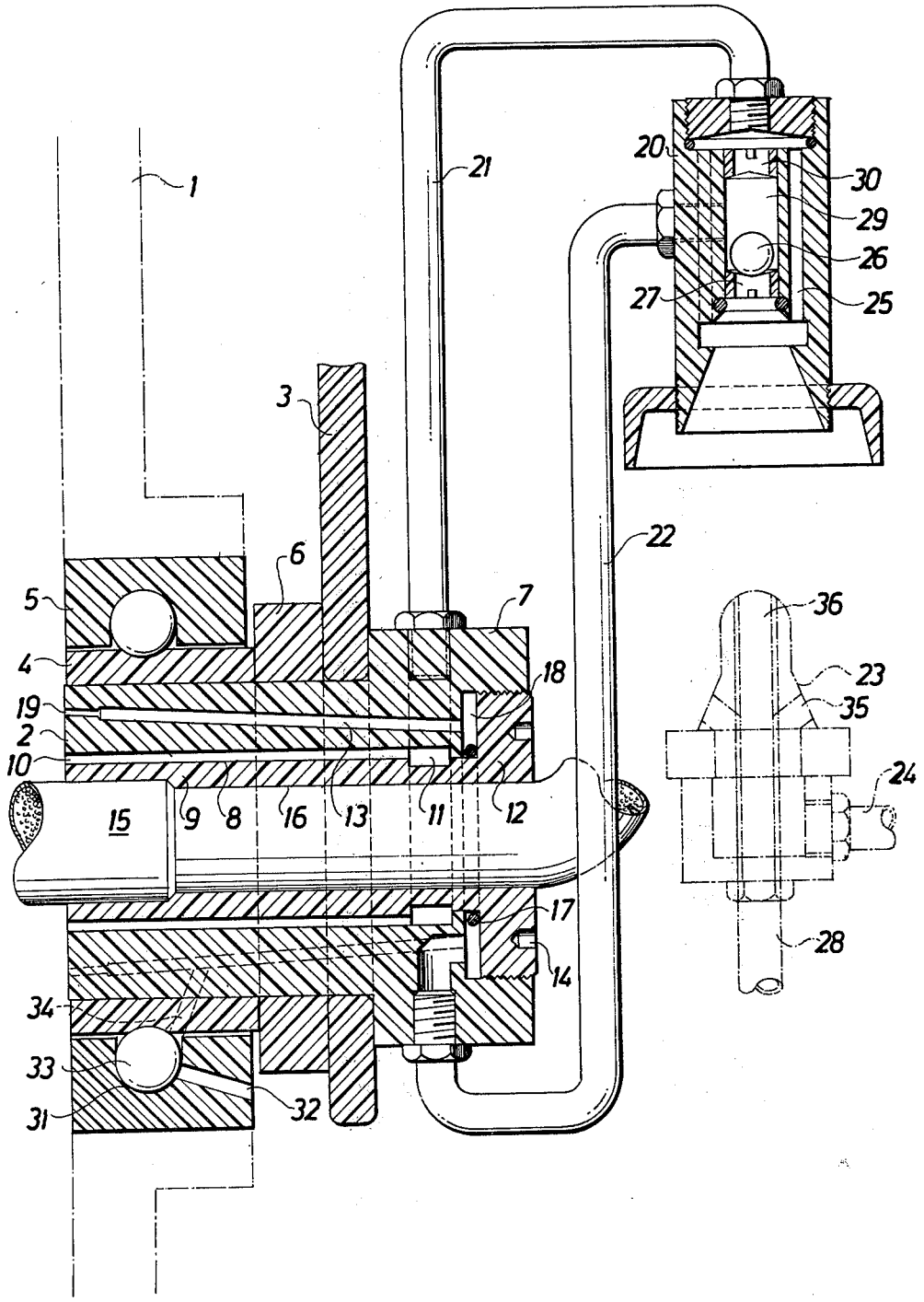
FIG. 3 is a longitudinal section through the rinsing trunnion bearing, a cleaning tube and a liquid distributing valve, also showing a ball bearing for supporting the electroplating drum.
Figure 4:
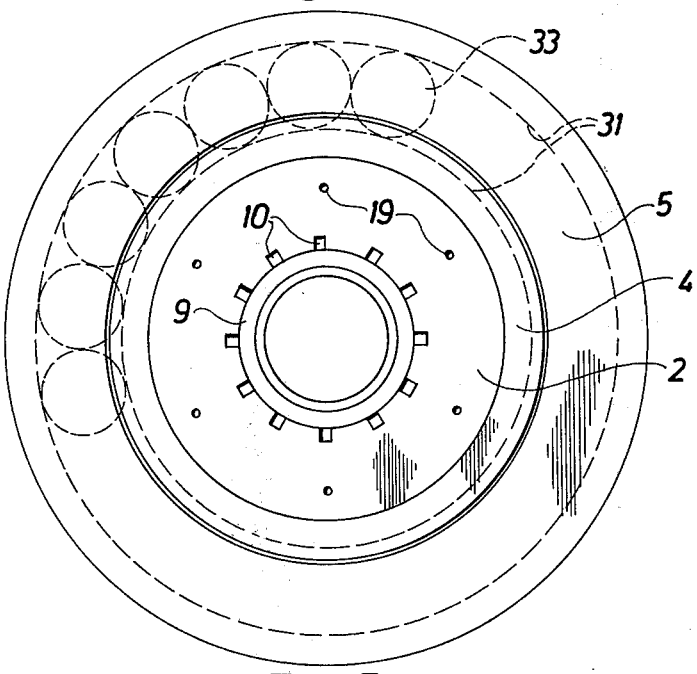
FIG. 4 shows the rinsing trunnion bearing as seen in the direction of the inside end wall of the electroplating drum.
Figure 5:
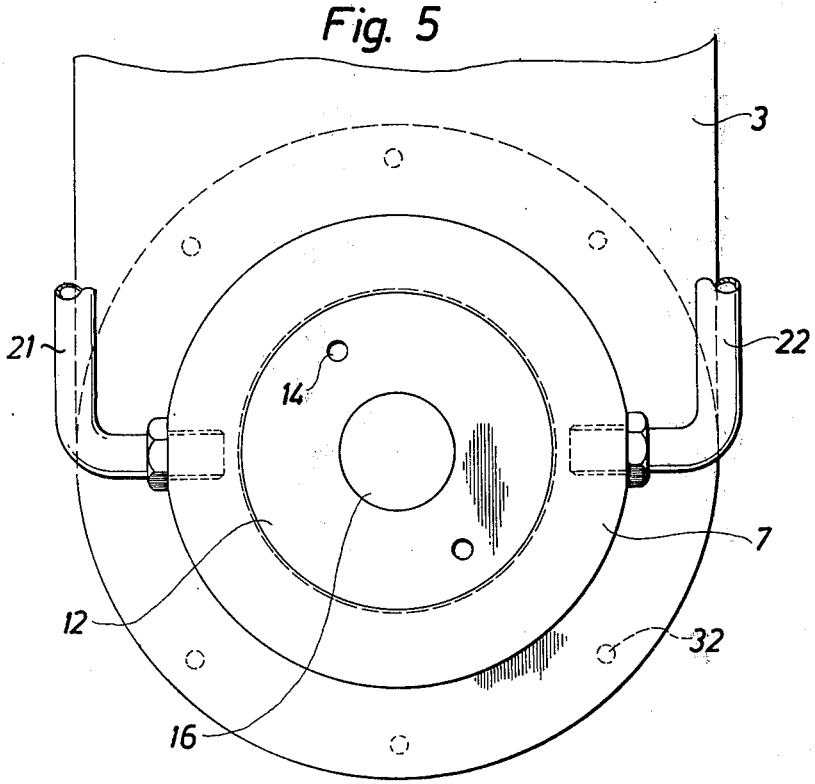
FIG. 5 shows the same as seen in the direction towards the outside of the above-mentioned end wall.

As can be seen from FIGS. 3, 4 and 5 the rinsing trunnion can be provided with a ball bearing, an inner face 4 of the ball bearing being mounted on the trunnion and an outer face 5 of the ball bearing being fitted into an end wall of the electroplating drum. A spacer collar 6, mounted on the rinsing trunnion bearing between the inner race 4 and the frame 3, defines the distance of the ball bearing from the frame and defines the distance between the means for mounting the rinsing trunnion bearing in the frame and a head 7 of the rinsing bearing trunnion.

The rinsing bearing trunnion 2 is provided with a central bore 8 the wall of which is provided with longitudinal flutes arranged in conjunction with a removable cleaning tube 9, which has a smooth surface and is inserted into the central bore, to form longitudinal ducts 10. These extend from an annular duct 11 which is situated in the rinsing trunnion bearing and in the cleaning tube. The cleaning tube 9 is provided with a screw-mounted head 12 which can be screw-mounted in corresponding screw-threading in the head 7 of the rinsing trunnion bearing. Normally, the cleaning tube is retained in position in the centre bore 8 of the rinsing trunnion bearing but can be unscrewed and removed therefrom, for example if it is necessary for the ducts 10 and 13 to be cleaned. To this end, the head 12 of the cleaning tube is provided with wrench-engaging means 14.

FIG. 3 also shows part of a current-carrying, flexible cable 15 which extends through an aperture 16 in the cleaning tube to the electroplating drum, as may be seen by reference to FIG. 1. A ring seal 17, arranged to provide sealing between the head 12 of the cleaning tube and the ducts 10 in the centre bore 8 and to define an annular connecting duct 18 around the cleaning tube 9, is disposed on the cleaning tube between the head 12 of the cleaning tube and the head 7 of the rinsing trunnion bearing.

Longitudinal ducts 13, situated in a ring outside the ducts 10, extend from the collecting duct 18 through the rinsing trunnion bearing. As can be seen from FIGS. 3 and 4, the ends 19 of the ducts 13 are offset towards the interior of the electroplating drum. These ends represent spraying apertures which finely divide the liquid and impart an enhanced rinsing effect to it.

A pipeline 21 is disposed between a liquid distribution valve 20, mounted on the frame, and the annular duct 11. The pipeline extends from the end of the liquid distribution valve 20, as shown in FIG. 3. Another pipeline 22 extends from the side of the liquid distribution valve and connects it to the collecting duct 18.

The frame 3, together with the electroplating drum 1 and the liquid distribution valve 20, is arranged for vertical adjustment and the liquid distribution valve can be lowered over the opening of a fixed valve seat 23 which is shown in broken lines in FIG. 3. The valve seat is connected to a duct 24 which carries recirculating rinsing liquid. The ends 35 of the duct extend to a lower level in the valve seat. From here, the recirculating rinsing liquid can flow through an outer duct system 25 in the liquid distribution valve 20 to the end of the liquid distribution valve. At this place, the liquid pressure actuates a valve ball 26 in a valve casing 29 to depress the ball which thus closes an inlet 27 for fresh water. The said inlet communicates with a central duct 36 which extends through the valve seat 23 and to a fresh water inlet duct 28 connected thereto.

The ball 26 therefore affords free passage to the two pipelines 21 and 22 and therefore via the collecting ducts 11 and 18 and the ducts 10 and 13 for the rinsing liquid which is recirculated into the electroplating drum 1. When operating together, the two duct systems 10 and 13 can supply a maximum quantity of recirculating rinsing liquid to the electroplating drum.

If the material is to be rinsed with fresh water or some other liquid, this will be supplied from the pipeline 28 and the pipeline 24 will be simultaneously closed. The pressure of the liquid in the pipeline 28 thrusts the valve ball 26 upwardly against the end of the valve casing 29 so that the valve ball blocks discharge 30 to the pipeline 21. The pipeline 28 is therefore connected only to the pipeline 22 and to the ducts 13 with their relatively small spraying apeball 26 upwardly against the end of the valve casing 29 so that the valve ball blocks discharge 30 to the pipeline 21. The pipeline 28 is therefore connected only to the pipeline 22 and to the ducts 13 with their relatively small spraying apertures 19. Fresh water is therefore supplied at a reduced rate to the electroplating drum and therefore to the material contained therein.

With the system described above, it is therefore possible to obtain a difference between the relatively large quantities of recirculating rinsing liquid, which can be supplied to the electroplating drum from the duct 24, and the reduced quantity of fresh water supplied from the duct 28. The illustrated arrangement in both cases ensures that a good rinsing effect is obtained because the liquid is pressed through the small spraying apertures 19 into the rinsing ducts 13.

As may be seen from FIGS. 3 and 4, the electroplating drum can be arranged to rotate by means of ball bearings 4 and 5 which are situated on the rinsing trunnion bearing. Apart from the known advantage of resistance to wear, this also offers the advantage that a ball bearing is exceptionally noiseless when compared with the plain bearings conventionally employed to this end.

FIG. 3 shows that a raceway 31 of the ball bearing is provided with a plurality of drainage apertures 32 to permit the discharge of rinsing water which escapes into the ball bearing. Rinsing liquid is also supplied to the bearng at an increased rate by virtue of the presence of a duct 34 which is provided between the raceway and one of the ducts 13.

In this way, the ball race and the ball bearing balls 33 are flushed with clean rinsing water whenever rinsing takes place, thus preventing salts dissolved in the bath becoming crystallized and thus impairing rotation.

To summarize, the preferred system operates as follows:

After the electroplating process, the material in the electroplating drum is coated with solution residue which is environmentally detrimental and which must be flushed away using the least possible addition of fresh water. This is achieved in the simplest manner by the perforated electroplating drum being set into slow rotation in a rinsing-flushing station, a known example of which is disclosed in Swedish Pat. No. 371,456, where rinsing and flushing are performed automatically with different liquids, different time intervals and in different combinations with the minumim addition of fresh water.

The material disposed in the electroplating drum in the preferred system can be rinsed or flushed or can only be flushed with the rinsing liquid which is admitted through different duct systems into the flushing bearing hubs. Cooperation between the different duct systems supplies a maximum quantity of rinsing liquid to the electroplating drum, a feature which is desirable when flushing is performed with recirculating liquids. It is on the other hand important to restrict the amount of liquid used for flushing with a once-only medium such as fresh water and for this reason all flushing of this kind in the preferred system is performed by means of flushing through the relatively small spraying apertures 19.

It is also important that the operator is able to readily clean the different ducts 10 and 13 when required after the cleaning tube 9 is removed from the rinsing trunnion bearing.

The preferred system offers the additional advantage that changing the electrolyte within the drum is greatly facilitated while the electroplating process is in progress. The exchange of liquid with the electroplating bath is performed mainly hydrostatically in electroplating drums which are flushed in conventional manner, i.e. the solution penetrates through the perforated wall of the electroplating drum.

It is generally known that an electroplating drum is able to exchange the solution contained therein, a feature which is of great significance for maintaining rapid metal deposition as well as a high and uniform quality of the deposited metal coating. A good exchange of bath solution ensures that the cathode film is always fresh so that fresh and unspent electrolyte is constantly supplied to the surface of the material to be treated. The principle of changing the electrolyte is the same as that described hereinabove for rinsing the material. When the electroplating drum is placed into an electroplating bath, the distribution valve, mounted in the frame, actuates a self-opening valve, not shown, which cooperates with the valve seat 23 and through which bath solution is supplied directly via the distributing valve and the rinsing trunnion bearings to the electroplating drum. This exchange of liquid is in progress for the entire duration of the electroplating process and is interrupted when the drum is lifted out of the bath.

I claim:

1. A system for supplying varying quantities of treatment liquids, comprising an electroplating drum to which said treatment liquids are supplied, a frame, rinsing trunnion bearings defining a plurality of sets of ducts, a removable cleaning tube, and a liquid distribution valve, wherein said rinsing trunnion ducts rotatably mount said electroplating drum in said frame, at least one of said rinsing trunnion bearings defining a central through bore and at least two of said sets of ducts having different sized openings disposed in respective series about said central bore, and said liquid distribution valve is disposed in said frame and operates to select between allowing said at least two sets of ducts to cooperate with each other and to perform separate rinsing functions, said through bore of said at least one rinsing trunnion bearing being defined by an inner surface thereof having axial flutes and said removable cleaning tube being inserted into said central bore, so that removal thereof makes said at least one set of ducts accessible for overhaul purposes, and said cleaning tube having a smooth cylindrical outer surface cooperating with said inner wall of said at least one rinsing trunnion bearing to define said at least one set of ducts.

2. A system as set forth in claim 1, wherein said liquid distribution valve incorporates a ball valve which, with the ball thereof in one position, is arranged to block the supply of liquid to said one set of ducts, and which, with said ball in a second position, is arranged to open the supply of liquid to all said sets of ducts.

3. A system as set forth in claim 1 wherein said at least one trunnion bearing defines relatively small spraying apertures opening into the interior of said electroplating drum and communicating with another of said at least two sets of ducts.

4. A system as set forth in claim 1, wherein said frame is vertically adjustable between a high position and a position in which said liquid distribution valve mounted on said frame cooperates with a fixed valve seat which is connected to different pipelines for supplying said treatment liquids.

* * * * *